US011592785B2

(12) United States Patent
Ferrandino

(10) Patent No.: US 11,592,785 B2
(45) Date of Patent: Feb. 28, 2023

(54) CHRONOGRAPH

(71) Applicant: GFIDEA S.R.L., Milan (IT)

(72) Inventor: Gabriele Ferrandino, Aversa (IT)

(73) Assignee: GFIDEA S.R.L., Milan (IT)

( * ) Notice: Subject to any disclaimer, the term of this patent is extended or adjusted under 35 U.S.C. 154(b) by 574 days.

(21) Appl. No.: 16/475,588

(22) PCT Filed: Nov. 21, 2017

(86) PCT No.: PCT/IB2017/057289
§ 371 (c)(1),
(2) Date: Jul. 2, 2019

(87) PCT Pub. No.: WO2018/127746
PCT Pub. Date: Jul. 12, 2018

(65) Prior Publication Data

US 2019/0324408 A1 Oct. 24, 2019

(30) Foreign Application Priority Data

Jan. 3, 2017 (IT) ..... 102017000000509

(51) Int. Cl.
*G04F 10/00* (2006.01)

(52) U.S. Cl.
CPC ..... *G04F 10/00* (2013.01)

(58) Field of Classification Search
CPC ..... G04F 10/00; G04G 9/00; G04C 3/00
See application file for complete search history.

(56) References Cited

U.S. PATENT DOCUMENTS 6,069,848 A * 5/2000 McDonald ..... G04G 9/00 368/107
7,948,832 B1 * 5/2011 Luo ..... G06Q 10/109 368/21
2005/0052954 A1 * 3/2005 Riedi ..... G04F 10/00 368/110

* cited by examiner

*Primary Examiner* — Sean Kayes
(74) *Attorney, Agent, or Firm* — Vorys, Sater, Seymour and Pease LLP

(57) ABSTRACT

Provided is a chronograph for including an electronic computer, power supply means, a non-volatile memory and a volatile memory; control means operatively connected to said computer; a display operatively connected to said computer; the electronic computer including electronic means, including a programme defined by a machine-type language for memorising a set date on said non-volatile memory which cannot be changed after the first setting, the electronic computer further including means for calculating the elapsed time between the set date and the current date.

7 Claims, 1 Drawing Sheet

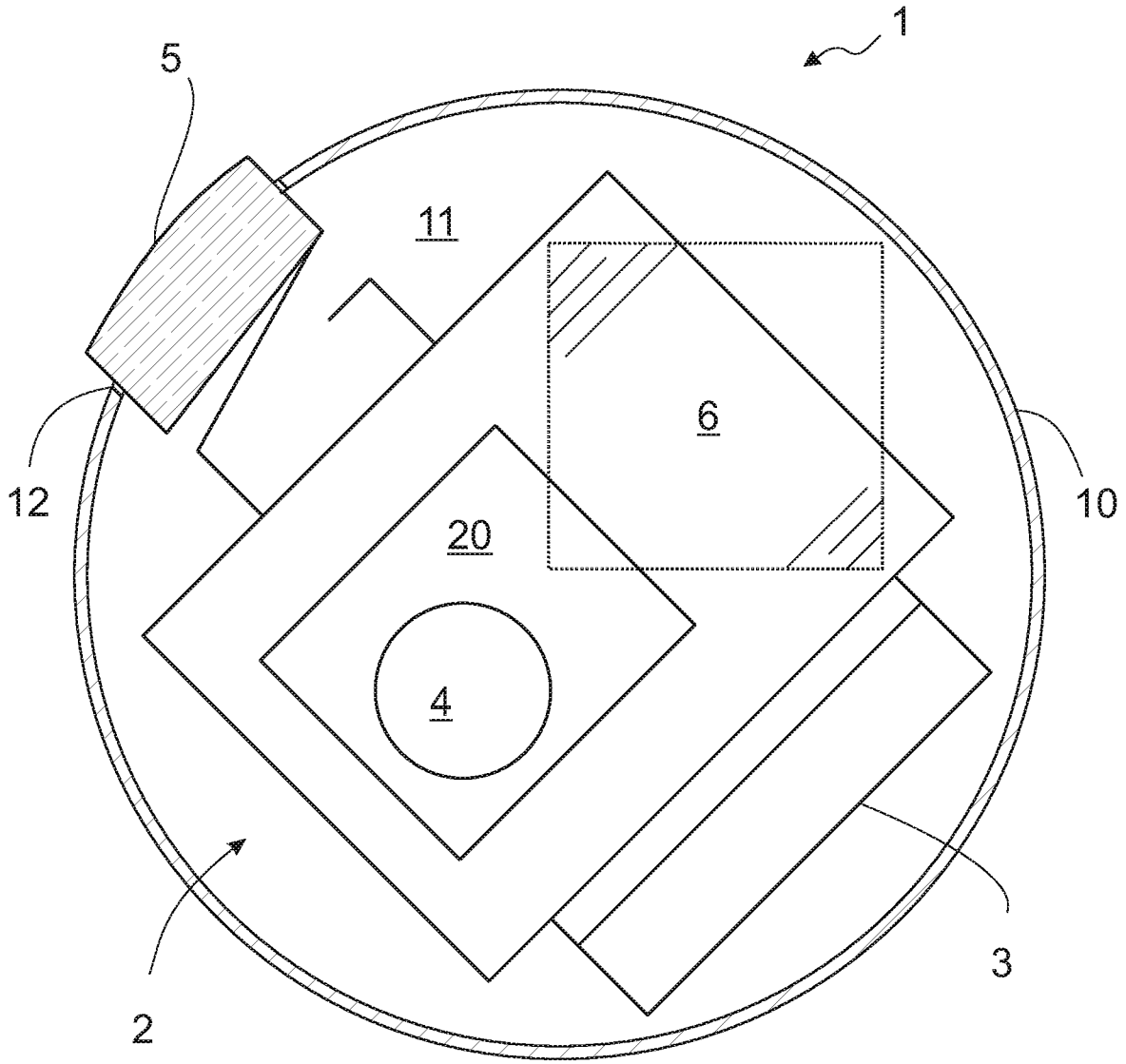
1
5
11
6
12
10
20
4
3
2

CHRONOGRAPH

The present invention relates to a chronograph of the type as recited in the preamble of the first claim.

In the state of the art chronographs are known of. In common usage the term chronograph has acquired, over time, a meaning increasingly oriented towards accuracy and precision. Typically, in fact, chronometers for medical, military or sports use able to record portions of time defined on command by the user are regarded as chronographs.

However the term chronograph refers generically to the ability to record time measured with an accuracy depending on the use of the same.

The first chronograph created in history was invented between 1815 and 1816 by Louis Moinet and is known as the "compteur de tierces".

It was an instrument of astronomical observation in which the central hand, suitable to complete a turn in one second, could be started, stopped and zeroed by a button.

There were also three other counters for minutes, hours and days.

Modern chronographs are not that different from Moinet's device, in fact the basic principles remain, but show improvements from a technical and operating point of view.

Mostly incorporated in watches, modern chronographs may in fact comprise improved internal mechanisms or lack them entirely and have totally different operating mechanisms.

Electronic devices such as computers or smartphones or others are able to incorporate within their software one or more programme suitable to simulate the functions of old chronographs.

Generally speaking a chronograph is defined as any device enabling limited portions of time to be recorded, with stopping and zeroing at will.

The prior art described has several significant drawbacks.

In particular, the chronographs in use allow portions of time to be recorded depending on the power supply of said chronograph.

For example a watch with a flat battery or a smartphone with a flat battery will not allow the time to be recorded inside the device.

Consequently, a significant drawback is that in the absence of a constant power supply the times which can be recorded are limited, if not brief, with respect for example to a decade.

In this situation the technical purpose of the present invention is to devise a chronograph able to substantially overcome at least some of the drawbacks mentioned.

Within the sphere of said technical purpose one important aim of the invention is to obtain a chronograph which is able to record a significant range of time regardless of the power supply thereof.

The technical purpose and specified aims are achieved by a chronograph as claimed in the appended claim 1. Examples of preferred embodiments are described in the dependent claims.

The characteristics and advantages of the invention are clearly evident from the following detailed description of preferred embodiments thereof, with reference to the accompanying drawings, in which:

FIG. 1 shows a diagram of the chronograph according to the invention.

Herein, the measures, values, shapes and geometric references (such as perpendicularity and parallelism), when used with words like "about" or other similar terms such as "approximately" or "substantially", are to be understood as except for measurement errors or inaccuracies due to production and/or manufacturing errors and, above all, except for a slight divergence from the value, measure, shape or geometric reference which it is associated with. For example, said terms, if associated with a value, preferably indicate a divergence of not more than 10% of said value.

In addition, where used terms such as "first", "second", "upper", "lower", "main" and "secondary" do not necessarily refer to an order, a priority relationship or relative position, but may simply be used to more clearly distinguish different components from each other.

With reference to the Drawings, reference numeral 1 globally denotes the chronograph according to the invention.

The chronograph 1 comprises a casing 10. In particular, the casing 10 may for example be a substantially hollow container defining an inner volume 11.

In addition, the casing may be defined by a hollow portion inside any object: within a frame, a decoration, an ornament for the body or an object of yet another kind. The chronograph 1 itself may, for example, comprise a clock within it.

The chronograph 1 preferably comprises a computer 2, power supply means 3, a non-volatile 4 and a volatile memory, appropriately inside the volume 11.

The computer 2 is preferably a computer of the type known in computer science and therefore it is composed for example of a processor 20 and a motherboard 21.

The processor 20 is preferably a micro-processor suitable to be incorporated in volumes having a small extension such as for example the inner volume 11.

The mother board 21 is instead preferably a known type of motherboard comprising a printed electrical circuit.

The power supply means 3 are preferably composed of one or more batteries, also of the known type. In addition, the power supply means 3 are suitable to provide the energy needed for the operation of the computer 2 and thus are operatively connected to it.

Preferably the power supply means 3 comprise a lithium battery.

The non-volatile memory 4 preferably consists of a medium inside which data can be recorded permanently.

In addition to the non-volatile memory 4, the device 1 preferably also comprises a volatile memory.

Preferably the non-volatile memory 4 is sufficient to record on it at least one programme defined by a machine-type language and a predetermined date, as described in detail below.

The term date is understood to mean at least one specific day, complete with the day of the month, month and year and also preferably also a specific time, in hours and minutes within the stipulated day.

A machine-type language is defined as a lowest-level computer language in which simple commands are given to the processor 20 suitable to promote a hardware processing.

In addition, the non-volatile memory of the physical storage device 4 is suitable to record, in addition, at least a set date.

The programme defined by machine language is therefore preferably suitable to calculate the elapsed time with respect to the date set on the non-volatile memory 4.

The set date is also non-editable or permanently recorded in a non-reversible manner on the non-volatile memory 4.

The non-volatile memory 4 is preferably an EEPROM type memory.

The computer 2, in particular the processor 20, and the non-volatile memory 4 can be integrated and thus be in a single piece. For example they can be constituted by the device marketed by ATMEL as the ATtiny441 model.

The electronic computer 2 and the non-volatile memory 4 are exclusively dedicated to said functions. They are therefore preferably not integrated into a more complex device that also performs other functions.

The chronograph 1 further comprises control means 5 and a display 6.

The control means 5 are preferably means suitable to control the operation of the computer 2 and thus are operatively connected to it.

However, the control means 5 preferably also communicate with the external environment.

Consequently, the housing 10 may thus have openings 12 suitable for housing connection elements, including the control means 5, communicating between the inner volume 11 and the outside of the chronograph 1.

Preferably the control means 5 are composed of a button or switch, suitable to activate the computer 2 and thus accessible from the outside.

The display 6 is instead preferably a graphic display suitable to provide information on the operation of the chronograph to a user.

Such a display may be both analogue and digital.

Preferably the display is an LCD OLED type.

In addition, the display 6 may be integrated with the control means 5. For example, the display 6 may be a display of the TOUCH SCREEN type and allow the activation of the computer 2 directly from the screen.

The display 6 is also preferably arranged in correspondence with an opening 12.

Preferably, if present, all the openings 12 are thus obstructed by the aforesaid control means 5 and/or by the display 6.

Preferably therefore the inner volume 11 is not accessible from the outside.

Not being accessible no element inside the inner volume 11 can be manually modified.

The functioning of the chronograph 1 described above in structural terms, is as follows.

A user can manually activate the control means 5 so as to turn the computer 2 on. In particular, an electrical impulse is sent to the motherboard 21 which activates the processor 20.

The processor 20 calls up the programme defined by machine language saved inside the non-volatile memory 4.

The programme makes it possible, in particular, preferably to save only once a date set and defined by the user that cannot be subsequently modified in any way.

Even in the case in which the power supply means 3 are flat and do not power the chronograph 1, the date set remains saved and readable but non-editable by the user in the event of the computer 2 being reactivated.

In addition, the programme enables the computer 2 to save a benchmark date on the volatile memory.

During all the settings, the information may be viewed by the user above the display 6.

The invention comprises a new process which comprises a first step, a second step, a third step, a fourth step and a fifth step.

In the first step the computer 2 is preferably activated by means of the control means 5.

In the second step the computer 2 preferably executes the programme comprised within the non-volatile memory of the physical storage device 4.

In the third step a user preferably defines a set date and the computer 2 records the set date on the physical storage device 4.

In the fourth step, the user preferably defines a benchmark date, the computer 2 records the benchmark data on the volatile memory and the computer 2 calculates the time elapsed between the benchmark date and the set date.

In the fifth step, the elapsed time is preferably displayed on the display 6.

In addition the first, second, fourth and fifth steps define a repeatable routine.

That is to say the routine may be activated more than once, for example as a result of a voluntary or involuntary shut-down (for example in case of a flat battery), to turn the computer 2 on.

Instead, preferably the third step can be performed only once.

The set date is in fact preferably recorded on the physical storage device 4 permanently and in a non-reversible or modifiable manner.

The invention comprises a new use.

In particular, in fact, the chronograph 1 is used to store a single date.

The chronograph 1 according to the invention achieves important advantages.

In fact, the chronograph 1 allows at least a period of time to be recorded regardless of the power supply means 3. Even in the case of a flat battery the set date recorded on the non-volatile memory can be recovered and used to calculate the elapsed time.

A further advantage is that the chronograph 1 can record a very extensive period of time, for example years or tens of years, without the time data being lost or deleted. Finally, a further advantage is that the chronograph 1 can be used to store particularly relevant dates, such as those related to an important event such as a birth or a wedding or otherwise, and can therefore be used as a commemorative object.

In addition, if the non-volatile memory 4 is integrated with the processor 20, it is not possible to modify, in any way, even by opening the chronograph, the non-volatile memory and thus the set date, given that the mechanical removal of the single non-volatile memory 4 is not possible without damage to the processor.

Variations may be made to the invention described herein without departing from the scope of the inventive concept defined in the claims.

For example the chronograph 1 can be incorporated within commemorative items such as rings or bracelets or otherwise, or itself may incorporate other devices such as the aforementioned clock internally.

Alternatively an additional memory card could be added, accessible from the outside, for film clips or photos to view on the display.

In said sphere all the details may be replaced with equivalent elements and the materials, shapes and dimensions may be as desired.

The invention claimed is:

1. A chronograph comprising an electronic computer, power supply means, a non-volatile memory and a volatile memory;

control means operatively connected to said computer;

a display operatively connected to said computer;

wherein said computer comprises electronic means, comprising a programme defined by a machine type language, configured to enable:

storing only once a set date by means of said control means in said non-volatile memory, so that said set date cannot be modified after the first setting, and saving by means of said control means a current benchmark date on the volatile memory, calculating the time elapsed between said set date and said current benchmark date, and displaying said time elapsed by means of said display, wherein said computer and said non-volatile memory are integrated in a single component, wherein said computer and said non-volatile memory are dedicated exclusively to executing said programme, recording said set date, calculating said time elapsed, and displaying said elapsed time.

2. The chronograph according to claim 1, wherein said non-volatile memory is an EPROM type memory.

3. The chronograph according to claim 1, wherein said computer comprises a processor and a motherboard.

4. A method implemented by means of a chronograph according to claim 1, comprising:

a first step wherein said computer is activated by means of said control means, a second step wherein said computer executes said programme comprised inside said non-volatile memory, a third step wherein a user defines said set date and said computer records said set date on said non-volatile storage device, a fourth step wherein said computer calculates the time elapsed between said set date and the current date, and wherein said first, second, fourth and fifth steps define a repeatable routine, and said third step can be performed only one time, wherein said computer and said non-volatile memory are integrated in a single component, wherein said computer and said non-volatile memory are dedicated exclusively to executing said programme, recording said set date, calculating said time elapsed, and displaying said elapsed time.

5. The method according to claim 4, comprising a fifth step in which said elapsed time is displayed on said display.

6. The method according to claim 4, wherein said non-volatile memory is an EPROM type memory.

7. The method according to claim 4, wherein said computer comprises a processor and a motherboard.

* * * * *